United States Patent [19]

Rollwage

[11] Patent Number: 4,923,365

[45] Date of Patent: May 8, 1990

[54] IMPELLER WHEEL FOR CONVEYING A MEDIUM

[75] Inventor: Mathias Rollwage, Gerlingen, Fed. Rep. of Germany

[73] Assignee: Robert Bosch GmbH, Stuttgart, Fed. Rep. of Germany

[21] Appl. No.: 146,728

[22] Filed: Jan. 21, 1988

[30] Foreign Application Priority Data

Mar. 14, 1987 [DE] Fed. Rep. of Germany ..... 3708336

[51] Int. Cl.[5] ..... F04D 29/66

[52] U.S. Cl. ..... 415/119; 415/55.1

[58] Field of Search ..... 416/203; 415/119, 55.1

[56] References Cited

U.S. PATENT DOCUMENTS 3,849,024 11/1974 Masai et al. ..... 415/53 T 4,253,800 3/1981 Segawa et al. ..... 415/119

4,403,910 9/1983 Watanabe et al. ..... 415/53 T 4,566,866 1/1986 Kemmner ..... 415/53 T

FOREIGN PATENT DOCUMENTS 12098 2/1981 Japan ..... 415/119

*Primary Examiner*—Robert E. Garrett

*Assistant Examiner*—John T. Kwon

*Attorney, Agent, or Firm*—Michael J. Striker

[57] ABSTRACT

An impeller wheel for feeding a medium, for example fuel, includes a plurality of vanes spaced from each other at non-uniform intervals along the periphery of the impeller wheel. To reduce tonal noise to a minimum during the feeding of the medium the vanes are distributed in accordance with the mathematical interrelations of a pseudonoise sequence.

7 Claims, 2 Drawing Sheets

IMPELLER WHEEL FOR CONVEYING A MEDIUM

BACKGROUND OF THE INVENTION

The present invention relates to an impeller wheel for conveying a medium of the type including a plurality of vanes spaced from each other.

The effect of a non-uniform distribution of intervals between the vanes of the impeller on the noise generation is determined in a frequency range. With a uniform distribution of vanes in the impeller a tone or a sound with frequency N $f_o$ and high harmonics thereof are produced wherein N is the number of vanes and $f_o$ is the rotation frequency of the impeller wheel. Without taking into consideration the uppertone the intensity/frequency spectrum of this noise consists of a discrete line which indicates the entire sound energy (FIG. 1*a*). The purpose of the non-uniform or irregular vane distribution is that the sound intensity of the single spectrum line be uniformly subdivided into many discrete lines in the frequency range so that each partial tone would be below the audible threshold of hearing.

An impeller has been known from DE-AS 1253402, in which the instructions have been given as to how the vane positions should be distributed on the periphery of the impeller wheel. Thereby a mathematical equation between the succession of the intervals between the vanes and the resulting noise spectrum has not been considered so that, for example the subdivision of the output spectrum can develop as shown in FIG. 1*b*, in which individual tones dominate. The degree of irregularity for a given successions of the vane intervals is defined in that the difference between the maximal and minimal interval is divided by the middle interval. This definition does not take into consideration the succession of different intervals which are very important for the aforementioned irregularity.

SUMMARY OF THE INVENTION

It is an object of this invention to provide an improved impeller.

The irregularity of a function or sequence can be read off as a function of its autocorrelation of its amplitude/-frequency spectrum. In this invention efforts have been made to obtain a flat or leveled amplitude/frequency spectrum (FIG. 1*c*), which is typical for white or blank noise. With a vane interval distribution of this invention, a flat discrete wide-band noise spectrum has been obtained, in which no spectrum portion is apperceived (FIG. 1*c*).

The stimulation processes are repeated periodically after each rotation of the impeller wheel, that is the noise signal has an initial frequency $f_o$ which is identical with an inverse rotation period. The intensity or amplitude/frequency spectrum of noise is thus discrete. Despite such deterministic repetitions a signal can be obtained which would have all the properties of a white or blank noise, namely a flat (discrete) amplitude/frequency spectrum or a quickly dropping autocorrelation function. Such properties are expressed by a so-called pseudo-noise sequence, i.e. a mathematical sequence of numbers which are calculated according to certain rules described below.

An example for a pseudo-noise sequence is a binary maximal length sequence which can be generated with a shift register. For clarification one assumes that the vane noise generated by an impeller with the uniform vane distribution, be sinusoidal with a single amplitude:

$$s(t) = \sin N\omega_o t;\ \omega_o = 2\pi f_o = \frac{2\pi}{T_o} \tag{1}$$

This sinusoidal function (1) is multiplied in beat with a maximum length sequence $\{a_k\}$ by $+1$ or $-1$, which can be conceived also as a phase shifting by 0° or 180°. The following function is obtained:

$$s(t) = \sin N\omega_o t \sum_{k=1}^{N} a_k\, rect\left\{\frac{t - k\,T_c}{T_c}\right\} \tag{2}$$

whereby rect $$\{x\} = \begin{matrix} 1, \leqq 0.5 \leqq x \leqq 0.5 \\ 0 \end{matrix}$$

otherwise, is a rectangle function and $T_c = T_o/N$ is the cycle time, that is the time of a rotation divided by the number of vanes.

In the spectral range the function (2), indicates a uniform distribution of a linear energy within frequency $f_o$ and its multiples. The distribution is in this case weighted with an interval function. The phase jumps in accordance with the maximum length sequence $\{a_k\}$ are, with the position of N vanes on the periphery of the impeller wheel realized so that the K-th vane would be positioned in the angle range:

$$\phi_k = \left(k - \frac{a_k)}{2} \cdot \frac{360°}{N}\right.;\ a_k = 0 \text{ or } 1. \tag{3}$$

Since the binary maximal length sequences have always the length $N = 2M - 1 (M = 3, 4, 5, \ldots)$, the number of vanes with this distribution would be only 7, 15, 31, 63, etc.

When another number of vanes N are necessary the intervals between the vanes are distributed in accordance with primitive-root- or quadratic-residue sequences which have aforementioned pseudo-noise properties. These sequences are not binary.

The chief advantage of the present invention resides in that pump sounds or noises arising from the impeller wheel are reduced to an absolute minimum.

The objects of this invention are attained by an impeller wheel for conveying a medium, including a plurality of vane-shaped conveying elements positioned on a peripheral surface of the wheel and spaced from each other in a peripheral direction of the wheel at non-uniform intervals which are determined in accordance with mathematical interrelations of a pseudonoise sequence.

The pseudonoise sequence may be the binary maximal length sequence (3) or a primitive root sequence or a quadratic residue sequence which will be described later.

The impeller wheel has a middle rotation plane, and two crowns of conveying elements or vanes are positioned at two opposite sides of the middle plane, the conveying elements being arranged so that an arrangement thereof in one crown corresponds to that of the other crown.

An arrangement sequence of conveying elements of one crown may be diametrically opposite to an arrangement sequence of the other crown.

The impeller wheel may be positioned in a pump chamber of a fuel conveying aggregate.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1A:
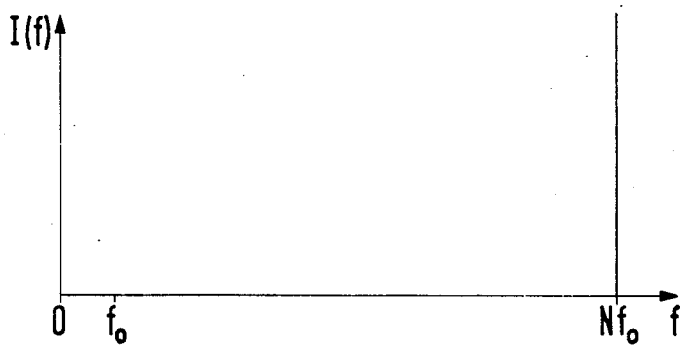
FIGS. 1*a* and 1*b* and 1*c* are graphs showing different ideal output spectra of conveyor noise.
Figure 1B:
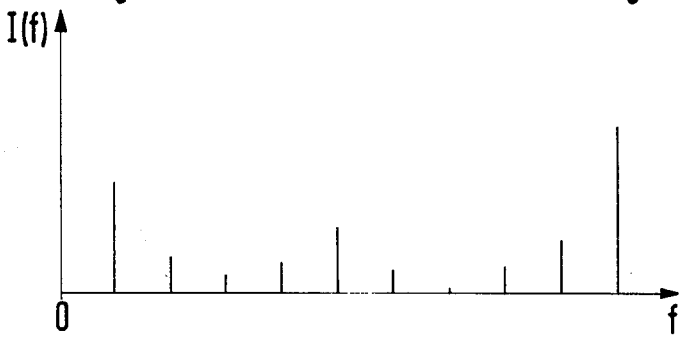
Figure 1C:
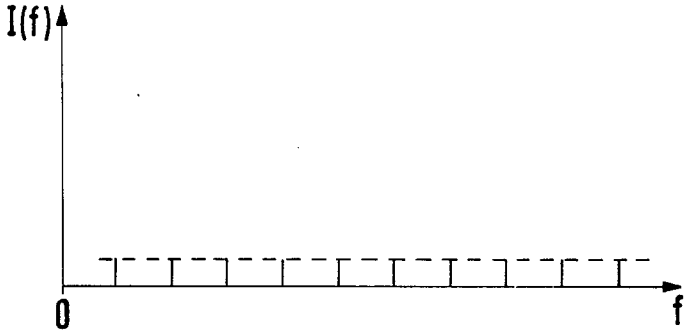
Figure 2:
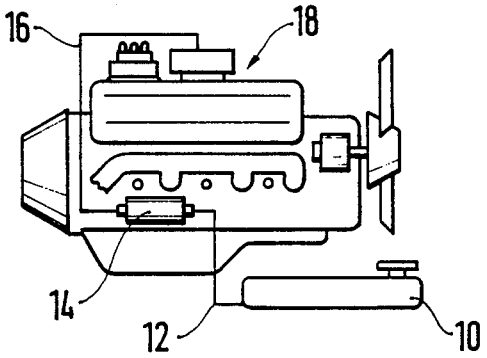
FIG. 2 is a schematic side view of the combination of the fuel feeding aggregate, fuel supply tank and internal combustion engine.

Referring now to the drawings in detail, and firstly to FIG. 2 thereof, it will be seen that a fuel supply tank 10 is connected via a suction line 12 with the suction side of a fuel feeding aggregate 14. A pressure conduit 16 is connected to the pressure side of the fuel feeding aggregate. Conduit 16 leads to an internal combustion engine 18. In operation of the internal combustion engine the fuel feeding aggregate delivers fuel from the supply tank 10 to the internal combustion engine 18.

Figure 3:
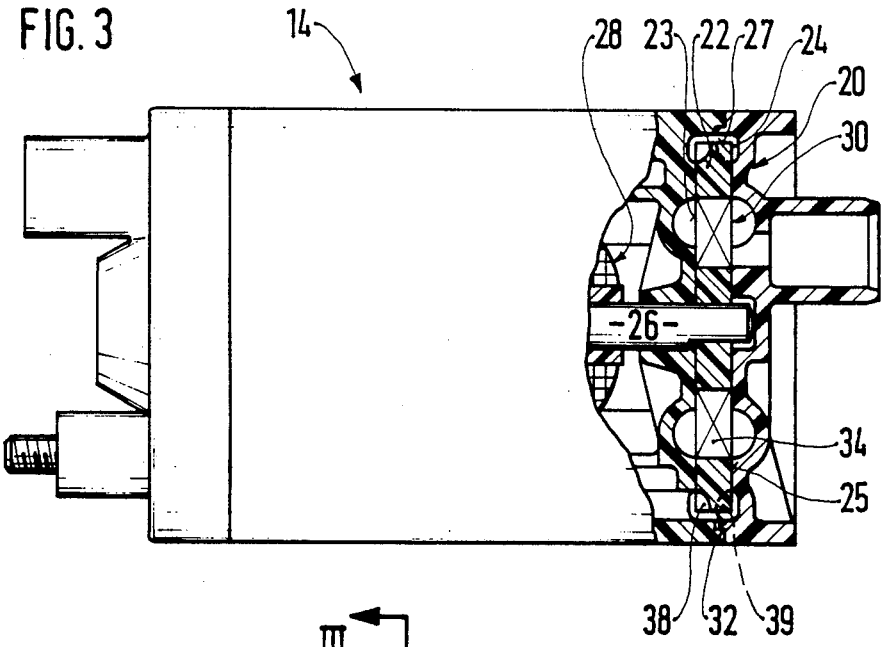
FIG. 3 is a side partially sectional, view taken along lines III—III of FIG. 4 of the fuel feeding aggregate in the chamber of which an impeller is positioned.
Figure 4:
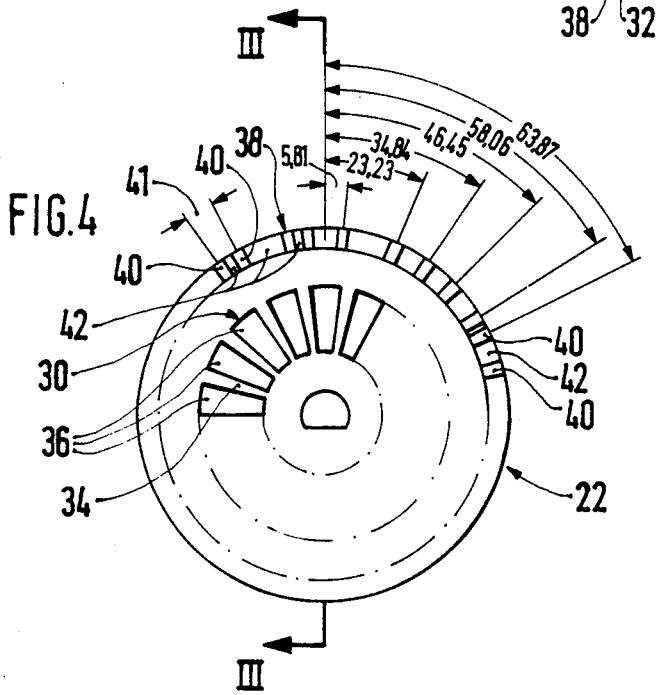
FIG. 4 is a front view of the impeller wheel.

With reference to FIGS. 3 and 4 it will be seen that a flow pump 20 of the fuel feeding aggregate has an impeller wheel 22 which is arranged in a pump chamber 24 of the fuel feeding aggregate 14. Impeller 22 is connected with a drive shaft 26 which is formed by an armature shaft of an electric motor 28 which is the part of the fuel feeding aggregate. In the proposed aggregate a two-stage flow pump is formed as a so-called WESTCO pump. It has a first inner crown 30 of conveying elements or vanes 34 and a second double crown 32 which consists of two outer crowns 38 and 39 of conveying elements or vanes 40. Each crown 30 and 32 of the conveying elements corresponds to one stage of the pump.

Conveying elements 34 of the inner crown 30 are spaced from each other by cut-outs 36 which extend parallel to the axis rotation of shaft 26. Cut-outs 36 are spaced from each other as shown in FIG. 4. As specifically seen from FIG. 3 the double crown 32 consists of two outer crowns 38 and 39 of conveying elements or vanes 40 which are provided at two opposing sides of a middle rotation plane of impeller 22. The middle rotation plane when the imaginary rotation plane which is viewed in the direction of the axis of rotation of shaft 26 is, in the middle region between two opposite end faces 23 and 25 of impeller 22.

The front view of the impeller 22 is shown in FIG. 4. Individual conveying elements or vanes 40 of outer crowns 38 and 39 are separated by cut-outs or recesses 42 at the two sides of the aforementioned middle rotation plane so that these vanes 40 are spaced at intervals 41 from respective neighboring vanes. Recesses 42 extend respectively from outer portions of either end face 23, 25 of the impeller 22 to its peripheral surface 27. As indicated in FIG. 4, each other vane crown 38 and 39 has 63 outer vanes 40 which are spaced from each other in the peripheral direction of impeller 22 by unequal distances 41. These distances 41 between individual vanes of crown 38 or 39 are dimensional in accordance with mathematical interrelations of a pseudo sound noise sequence. In the following table I, an example of the maximum length sequence $Q_k$ of the length 31 is set forth. The individual fuel conveying elements or vanes 40 are numbered from 1 to 31 in column k. The second column $a_k$ shows the binary maximal length sequence from which the position of each vane in accordance with the equation (3) is calculated. The transition from 0 to 1 corresponds to the step of 5.81 degrees whereas the transition from 1 to 0 corresponds to the step of 17.42 degrees. $\phi_k$ in the third column of the table I identifies the positions of the individual conveying elements in the range defined from the middle between the conveying element 1 and the conveying element 31.

An impeller with 31 vanes is subdivided according to the binary maximal length sequence (3), i.e.

TABLE I $$\phi_k = \left(k - \frac{a_k)}{2}\right. \frac{360°}{31}$$

| k | $a_k$ | $\phi_k$ | k | $a_k$ | $\phi_k$ |
|---|---|---|---|---|---|
| 1 | 1 | 5.81 | 16 | 1 | 180.00 |
| 2 | 0 | 23.23 | 17 | 1 | 191.61 |
| 3 | 0 | 34.84 | 18 | 1 | 203.23 |
| 4 | 0 | 46.45 | 19 | 0 | 220.65 |
| 5 | 0 | 58.06 | 20 | 1 | 226.45 |
| 6 | 1 | 63.87 | 21 | 0 | 243.87 |
| 7 | 1 | 75.48 | 22 | 0 | 255.48 |
| 8 | 1 | 87.10 | 23 | 0 | 267.10 |
| 9 | 0 | 104.52 | 24 | 1 | 272.90 |
| 10 | 0 | 116.13 | 25 | 0 | 290.32 |
| 11 | 1 | 121.94 | 26 | 0 | 301.94 |
| 12 | 1 | 133.55 | 27 | 1 | 307.74 |
| 13 | 0 | 150.97 | 28 | 0 | 325.16 |
| 14 | 1 | 156.77 | 29 | 1 | 330.97 |
| 15 | 1 | 168.39 | 30 | 1 | 348.39 |
| | | | 31 | 1 | 354.19 |

The binary maximal length sequence ensures reduction of pump noises originating from the impeller 22 to an unavoidable minimum. The crown of conveying elements or vanes 39 on the other side of the middle plane fully corresponds to the arrangement clarified by the table above. The arrangement sequences of the crown of vanes 38 are provided diametrically opposite the corresponding arrangement sequences of the other crown vanes 39. It is evident that the vane distribution is exempt from an arbitrary distribution, according to the principle that the sound intensity should be uniformly distributed in the frequency range. These spectral properties include pseudo sound noise sequences, particularly binary maximal length sequences. The advantage of the vane distribution in accordance with the binary maximal sequence is the limiting to three different intervals or distances between the vanes.

A further example is the impeller with 18 vanes in which the intervals between the vanes are distributed according to a primitive root sequence. The sequence depends on the prime number p=19 and their primitive root g=2 and is formed according to the principle:

$$a_k = g^k (\text{mod } 19);\ (k=1, 2, \ldots, 18) \quad (4)$$

The table II, that is set forth below, has three columns, of which the first column indicates the ordinal number k of the vanes, the second column identifies the primitive root sequence $\{a_k\}$ and the third column shows the angle of the position of the respective vanes. The first vane is positioned at angle 0°. The position of the vane results from the predecessor position according to the recurrence equation:

$$\phi k = \phi k - 1 + 10.5° + 1° a_{k-1};\ (k=2, \ldots, 18) \quad (5)$$

Since $\phi_1 = 0°$ and $a_1 = 2$, $$\phi_2 = 0° + 10.5° + 2° = 12.5° \text{ and so forth.}$$

The constant addition of 10.5° to the sequence dependent value in the equation (5) is necessary in order not to allow the difference between the greatest and the smallest interval to be too large to offset the efficiency of the pump.

TABLE II

| k | $a_k$ | $\phi k$ |
|---|---|---|
| 1 | 2 | 0° |
| 2 | 4 | 12.5° |
| 3 | 8 | 27° |
| 4 | 16 | 45.5° |
| 5 | 13 | 72° |
| 6 | 7 | 95.5° |
| 7 | 14 | 113° |
| 8 | 9 | 137.5° |
| 9 | 18 | 157° |
| 10 | 17 | 185.5° |
| 11 | 15 | 213° |
| 12 | 11 | 238.5° |
| 13 | 3 | 260° |
| 14 | 6 | 273.5° |
| 15 | 12 | 290° |
| 16 | 5 | 312.5° |
| 17 | 10 | 328° |
| 18 | 1 | 348.5° |

A further possibility for the impeller is that the intervals between the vanes can be distributed in accordance with the quadratic residual sequence. The exemplified sequence depends on the prime number p=17. The quadratic residuals $\{a_k\}$ are determined according to the following equation:

$$a_{k=k}{}^2 \text{ (mod p)};\ (k=1, \ldots, 16) \quad (6)$$

The impeller 22 has 16 vanes. The table III which is shown below has three columns the first of which indicates the ordinal number k of the vanes, the second column shows the sequence $\{a_k\}$ of quadratic residuals and the third column shows the angular position of the corresponding vanes. The first vane is positioned at angle 0°. The position of the vane can be defined from the predecessor position according to the following recurrent equation:

$$\phi_k = \phi_{k-1} + 14° + 1° a_{k-1};(k=2, \ldots, 16) \quad (7)$$

Since $\phi_1 = 0°$ and $a_1 = 1$, $\phi_2 = 0° + 14° + 1° = 15°$. The constant addition of 14° to the sequence-dependent value in equation (7) is necessary in order not to allow the difference between the greatest interval and the smallest interval to be too large to affect the efficiency of the impeller.

TABLE III

| k | $a_k$ | $\phi k$ |
|---|---|---|
| 1 | 1 | 0° |
| 2 | 4 | 15° |
| 3 | 9 | 33° |
| 4 | 16 | 56° |
| 5 | 8 | 86° |
| 6 | 2 | 108° |
| 7 | 15 | 124° |
| 8 | 13 | 153° |
| 9 | 13 | 180° |
| 10 | 15 | 207° |
| 11 | 2 | 236° |
| 12 | 8 | 252° |
| 13 | 16 | 274° |
| 14 | 9 | 304° |
| 15 | 4 | 327° |
| 16 | 1 | 345° |

It will be understood that each of the elements described above, or two or more together, may also find a useful application in other types of differing from the impellers for conveying a medium types described above.

While the invention has been illustrated and described as embodied in an impeller for conveying a medium, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An impeller wheel for conveying a medium, including a plurality of vane-shaped conveying elements positioned on a peripheral surface of the wheel and spaced from each other in a peripheral direction of the wheel at non-uniform intervals, said intervals being dimensioned in accordance with the mathematical interrelations of pseudonoise sequence.

2. The impeller wheel as defined in claim 1, wherein said pseudonoise sequence is a binary maximal length sequence.

3. The impeller wheel as defined in claim 1, wherein said pseudonoise sequence is a primitive root sequence.

4. The impeller wheel as defined in claim 1, wherein said pseudonoise sequence is a quadratic residual sequence.

5. The impeller wheel as defined in claim 1, which has a middle rotation plane and two crowns of conveying elements positioned at two sides of said plane, said conveying elements being arranged so that an arrangement of said conveying elements of one crown corresponds to that of the other crown.

6. The impeller wheel as defined in claim 5, wherein an arrangement sequence of conveying elements of one crown is diametrally opposite to an arrangement sequence of the other crown.

7. The impeller wheel as defined in claim 1, wherein the impeller wheel is positioned in a pump chamber of a fuel conveying aggregate.

* * * * *